US008224202B2

(12) United States Patent
Urano

(10) Patent No.: US 8,224,202 B2
(45) Date of Patent: Jul. 17, 2012

(54) IMAGE FORMING DEVICE, PRINTING SYSTEM, AND PRINTING METHOD

(75) Inventor: Etsuaki Urano, Okazaki (JP)

(73) Assignee: Konica Minolta Business Technologies, Inc., Chiyoda-ku, Tokyo (JP)

( * ) Notice: Subject to any disclaimer, the term of this patent is extended or adjusted under 35 U.S.C. 154(b) by 126 days.

(21) Appl. No.: 12/719,056

(22) Filed: Mar. 8, 2010

(65) Prior Publication Data

US 2010/0239298 A1 Sep. 23, 2010

(30) Foreign Application Priority Data

Mar. 19, 2009 (JP) ..... 2009-067820

(51) Int. Cl.
*G03G 15/20* (2006.01)

(52) U.S. Cl. ..... 399/69

(58) Field of Classification Search ..... 219/216; 399/67, 69, 328, 329, 334, 406
See application file for complete search history.

(56) References Cited

U.S. PATENT DOCUMENTS

| | | | | |
|---|---|---|---|---|
| 5,890,032 | A | 3/1999 | Aslam et al. | |
| 2006/0083536 | A1 | 4/2006 | Shishido | |
| 2006/0171749 | A1 * | 8/2006 | Tomita et al. | 399/329 |

FOREIGN PATENT DOCUMENTS

| | | | |
|---|---|---|---|
| CN | 1763654 | | 4/2006 |
| JP | 04-216580 | | 8/1992 |
| JP | 11-242399 | A | 9/1999 |
| JP | 2002-006656 | | 1/2002 |
| JP | 2004-085634 | A | 3/2004 |
| JP | 2005-181474 | A | 7/2005 |
| JP | 2007-017495 | A | 1/2007 |
| JP | 2007-078787 | | 3/2007 |

OTHER PUBLICATIONS

European Search Report dated Jun. 11, 2010, issued in the corresponding European Application No. 10156877.2-2209.
Notification of the First Office Action dated Jun. 24, 2011, issued in the corresponding Chinese Patent Application No. 201010138219.X, and an English Translation thereof.

* cited by examiner

*Primary Examiner* — Hoang Ngo
(74) *Attorney, Agent, or Firm* — Buchanan Ingersoll & Rooney PC

(57) ABSTRACT

A fixing device including: an endless belt that is driven to perform a circulating motion; a pressing member and a fixing roller that face each other with the endless belt therebetween, the pressing member being caused to press the fixing roller, which is preliminarily heated, via the belt to form a fixing nip in which a toner image is thermally fixed onto a recording sheet S passing through therein; a cooler that cools at least a paper-contact range of the belt within which the recording sheet S passing through the fixing nip contacts; and a temperature-decrease controller that causes the cooler to cool at least the paper-contact range of the belt before the toner image is thermally fixed onto the recording sheet S.

13 Claims, 6 Drawing Sheets

FIG. 5

| Type of recording sheet | Preset target temperature (°C) | Target temperature (°C) |
|---|---|---|
| Regular paper ($60g/m^2$) | 130 | 170 |
| Thick paper ($200g/m^2$) | 95 | 180 |

IMAGE FORMING DEVICE, PRINTING SYSTEM, AND PRINTING METHOD

CROSS-REFERENCE TO RELATED APPLICATIONS

This application is based on an application No. 2009-67820 filed in Japan, the contents of which are hereby incorporated by reference.

BACKGROUND OF THE INVENTION (1) Field of the Invention

The present invention relates to a fixing device for use in a printer, a facsimile device, a copier or the like, and to an image forming device provided with the fixing device, and especially to a technology for preventing generation of gloss difference on toner images fixed by a fixing member.

(2) Related Art

In recent years, among fixing devices for use in an image forming device such as a printer, a facsimile device, and a copier, more and more fixing devices have been made to thermally fix a toner image onto a recording sheet via a belt having small heat capacity for energy saving.

For example, Japanese Patent Application Publication No. 2007-17495 (Patent Document 1) discloses a fixing device which is configured to make a recording sheet, on which a toner image has been transferred, pass through a fixing nip to thermally fix the toner image onto the recording sheet, where the fixing nip is formed by causing a pressing roller to press a fixing roller via an endless fixing belt that is driven to perform a circulating motion.

In such a fixing device, when the recording sheet passes through the fixing nip area, heat is absorbed by the recording sheet from a part of the fixing belt that contacts the recording sheet. As a result of this, in the fixing belt, a difference in temperature is generated between the part that contacted the recording sheet and the other part.

Furthermore, when the succeeding recording sheet is subjected to the thermal fixing while the succeeding recording sheet is on the part of the fixing belt that contacted the previous recording sheet and lost heat, the fixing temperature for the succeeding recording sheet is lower than the fixing temperature for the previous recording sheet, resulting in a difference in gloss level (gloss difference) between the fixed toner images on the previous and succeeding recording sheets.

Also, when the recording sheet is long in the direction in which the recording sheet passes through the fixing nip area, there will be a gloss difference between parts of the same recording sheet. The gloss level of the toner image varies depending on the fixing temperature. Therefore, the larger the rate of decrease in the fixing temperature is, the larger the gloss difference is. In the above-described fixing device, to lessen the gloss difference, the recording sheet is pre-heated by the heater before it is transported to the fixing nip area.

With the pre-heating, the difference in temperature between the recording sheet and the fixing belt is reduced, and thus the amount of heat to be absorbed by the recording sheet from the fixing belt is reduced. As a result of this, the difference in temperature between the part of the fixing belt from which the heat is absorbed by the recording sheet and the other part is reduced. This makes it possible to lessen the gloss difference that is generated between different recording sheets or between different parts of a same recording sheet.

However, when, as in the technology disclosed in Patent Document 1, the recording sheet is pre-heated by the heater, the temperature inside the image forming device is increased, and the developing unit located near the heater is also heated. This produces a problem that the toner stored in the developing unit is apt to become hard by the influence of the heat, having an adverse effect on the image forming operation.

SUMMARY OF THE INVENTION

An object of the present invention is therefore to provide a fixing device that can prevent generation of the gloss difference without increasing the temperature in the image forming device.

One aspect of the present invention for fulfilling the above-described object is a fixing device comprising: an endless belt that is driven to perform a circulating motion; a pressing member and a fixing roller that face each other with the endless belt therebetween, the pressing member being caused to press the fixing roller, which is preliminarily heated, via the belt to form a fixing nip in which a toner image is thermally fixed onto a recording sheet passing through therein; a cooler that cools at least a paper-contact range of the belt within which the recording sheet passing through the fixing nip is to contact; and a temperature-decrease controller that causes the cooler to cool at least the paper-contact range of the belt before the toner image is thermally fixed onto the recording sheet.

In the above-stated fixing device, the pressing member may be provided inside a circulating path of the belt, and the fixing roller may be a heating roller and may be provided to face an outer surface of the belt.

Also, another aspect of the present invention is an image forming device that includes the above-described fixing device.

With the above-described structure, at least the paper-contact range of the belt forming the fixing nip is cooled before the toner image is thermally fixed onto the recording sheet. This reduces the difference in temperature between the recording sheet and the paper-contact range of the belt, and reduces the amount of heat absorbed from the belt by the recording sheet when the recording sheet has contacted a part of the belt during the thermal fixing. This reduces the decrease in temperature of the part of the belt that contacted the recording sheet.

Accordingly, the above-described structure reduces the difference in temperature between the part that contacted the recording sheet and the part that did not contact the recording sheet in the paper-contact range of the belt, and reduces the difference in the fixing temperature between (i) when the thermal fixing is performed onto the recording sheet via a part of the belt that contacted the previous recording sheet and (ii) when the thermal fixing is performed onto the recording sheet via a part of the belt that did not contact the previous recording sheet. This reduces or prevents the gloss difference generated on the toner image fixed on the recording sheet by thermal fixing because the gloss difference is generated when there is a difference in the fixing temperature between continuously performed thermal fixings.

Furthermore, since the above-described reduction in temperature difference is realized by cooling the belt, the gloss difference is reduced without increasing the temperature inside the image forming device.

In the above-stated fixing device, the temperature-decrease controller may cool the belt by as much degree of temperature as is expected to decrease when the recording sheet passes through the fixing nip and contacts the belt.

In the above-stated fixing device, the temperature-decrease controller may cool the belt by as much degree of temperature as is expected to decrease by absorption of heat by the recording sheet from the belt in the thermal fixing.

With the above-described structure, a control is performed sot that, before the recording sheet enters the fixing nip so as to be fixed with a toner image by thermal fixing, the belt is cooled by as much degree of temperature as is expected to decrease when the recording sheet passes through the fixing nip and contacts the belt, or as is expected to decrease by absorption of heat by the recording sheet from the belt in the thermal fixing. Thus the above-described structure prevents a gloss defect from being generated, where the gloss defect is generated when the belt is cooled and the thermal fixing temperature is lowered excessively, resulting in decrease of gloss level of the toner image after the thermal fixing. The above-described structure reduces the amount of heat that is absorbed by the recording sheet from the belt in the thermal fixing to a slight amount, and reduces the gloss difference further.

In the above-stated fixing device, the belt may be made of a metal having a heat conductivity. This structure accelerates the heat transfer between the belt part that has contacted the recording sheet and the other belt part that has not contacted the recording sheet to reduce the difference in temperature therebetween, and thus accelerates equalization of temperatures in the belt, and reduces the gloss difference further.

In the above-stated fixing device, the degree of temperature by which the belt is cooled by the temperature-decrease controller may be preset for each type of recording sheet or for each size of recording sheet. With this structure, it is possible to optimize the degree of temperature by which the belt is cooled, based on the type or size of recording sheet.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings:

FIG. 5 shows a specific example of the target preset temperature table; and

DESCRIPTION OF THE PREFERRED EMBODIMENTS

The following describes an image forming device as an embodiment of the present invention, taking, as an example, a case in which the invention is applied to a tandem-type color digital printer (hereinafter merely referred to as a "printer").

[1] Structure of Printer

First, the structure of the image forming device in the present embodiment will be described.

Figure 1:
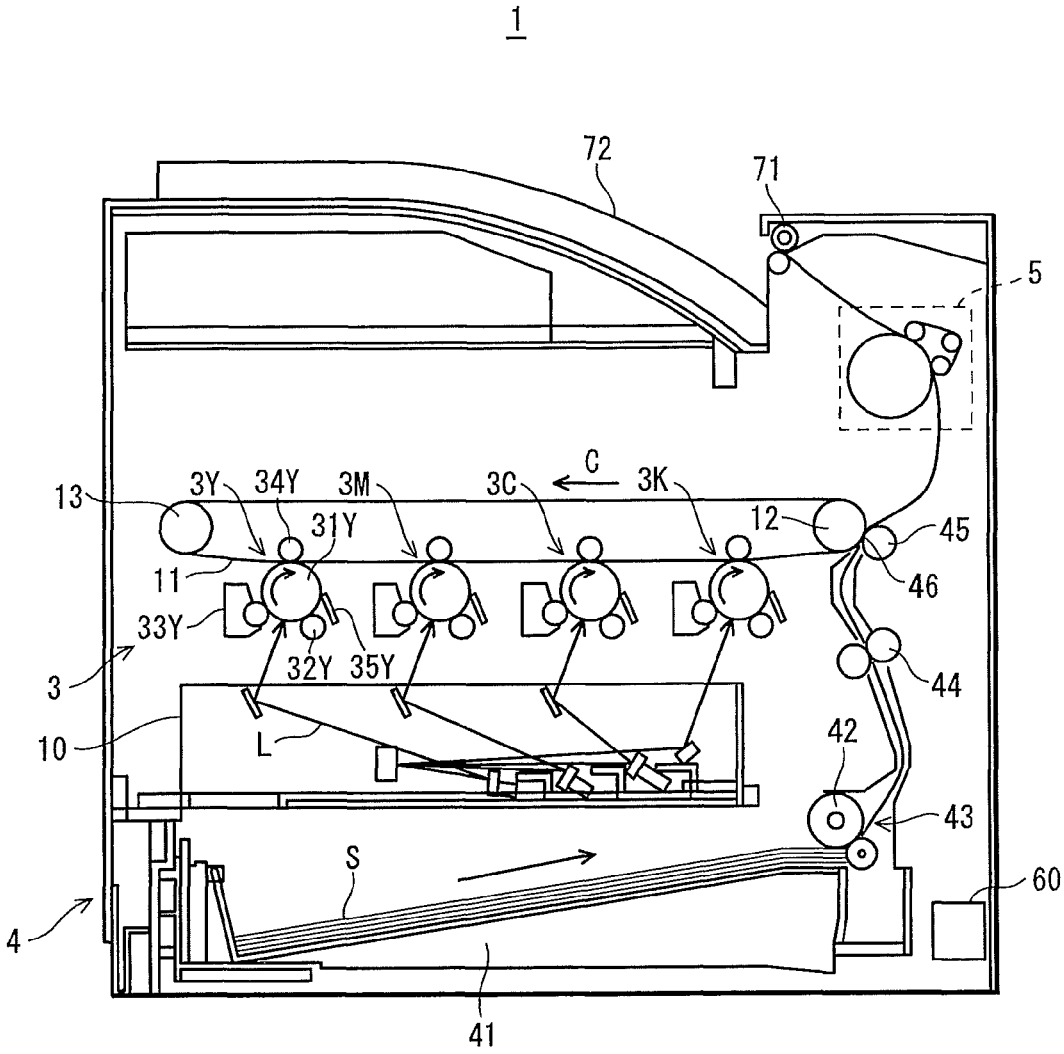
FIG. 1 shows the structure of the printer 1.

FIG. 1 shows the structure of a printer 1 in the present embodiment.

As shown in FIG. 1, the printer 1 is provided with an image processor 3, a paper feeder 4, a fixing device 5, and a controller 60.

The printer 1 is connected with a network (for example, a LAN), and upon receiving an instruction to execute a print job, from an external terminal device (not illustrated), forms toner images of colors yellow, magenta, cyan, and black based on the received instruction, and transfers the toner images onto paper by multi-transfer as a full-color image forming process.

In the following, the reproduction colors of yellow, magenta, cyan, and black are respectively represented as Y, M, C, and K, and these signs Y, M, C, and K are added, as additional characters, to the reference numbers of the structural elements that respectively correspond to the reproduction colors.

The image processor 3 includes image formers 3Y, 3M, 3C, and 3K, an exposure unit 10, an intermediate transfer belt 11, and the like.

The image formers 3Y, 3M, 3C, and 3K have a similar structure. Accordingly, the following description focuses on the image former 3Y.

The image former 3Y includes a photosensitive drum 31Y, a charger 32Y, a developing unit 33Y, an initial transfer roller 34Y, and a cleaner 35Y, where the charger 32Y, developing unit 33Y, initial transfer roller 34Y, and cleaner 35Y are placed around the photosensitive drum 31Y, and the cleaner 35Y is provided to clean the photosensitive drum 31Y. With this structure, a toner image of color yellow is formed on the photosensitive drum 31Y.

The developing unit 33Y, placed to face the photosensitive drum 31Y, transfers charged toner to the photosensitive drum 31Y.

The intermediate transfer belt 11 is an endless belt that is suspended with tension between a drive roller 12 and a passive roller 13, and is driven to rotate in the direction indicated by the arrow C shown in FIG. 1.

The exposure unit 10 is provided with a light-emitting element such as a laser diode. Upon receiving a drive signal from the controller 60, the exposure unit 10 emits a laser beam L to form an image with the colors Y through K, and exposure-scans each photosensitive drum of the image formers 3Y, 3M, 3C, and 3K.

With the exposure-scanning, a static latent image is formed on the photosensitive drum 31Y having been charged by the charger 32Y. Similarly, static latent images are formed respectively on the photosensitive drums of the image formers 3M, 3C, and 3K.

The static latent images formed on the photosensitive drums are developed by the respective developing units of the image formers 3Y, 3M, 3C, and 3K, so that toner images of corresponding colors are formed on the respective photosensitive drums. After this, the toner images are sequentially transferred by the initial transfer rollers of the image formers 3Y, 3M, 3C, and 3K onto the intermediate transfer belt 11 at different timings to be overlaid on the same position of the intermediate transfer belt 11.

The paper feeder 4 includes a paper-feed cassette 41 for housing recording sheets that are represented by the sign "S" (Note that the paper that can be used as the recording sheet includes paper of a variety of thickness such as regular paper and thick paper, and a film sheet such as an OHP sheet. In this example, paper is used as the recording sheet), a roller 42 for feeding the recording sheets S one by one from the paper-feed cassette 41 onto the transport path 43, and a pair of timing rollers 44 for taking a timing for transporting each fed recording sheet S onto a second transfer position 46. With this structure, the paper feeder 4 transports a recording sheet S from the paper-feed cassette 41 onto the second transfer position 46 in synchronization with the timings at which the toner images on the intermediate transfer belt 11 move. Then, by the action of the electrostatic force of a second transfer roller 45, the toner images are transferred collectively from the intermediate transfer belt 11 onto the recording sheet S as the second transfer.

The recording sheet S having passed the second transfer position 46 is further transported to the fixing device 5, in which the toner image (unfixed image) on the recording sheet S is given heat and pressure to be fixed onto the recording sheet S by the thermal fixing, and then the recording sheet S is ejected into an ejection tray 72 via a pair of ejection rollers 71.

Figure 2:
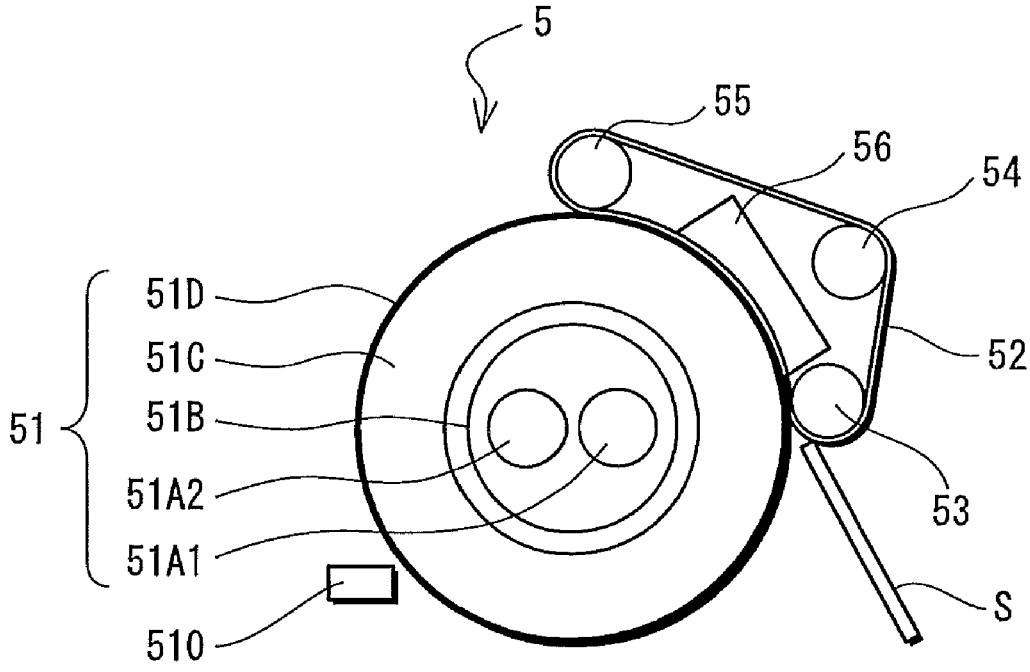
FIG. 2 is a cross-sectional view showing the structure of the fixing device 5.

FIG. 2 is a cross-sectional view showing the structure of the fixing device 5. As shown in FIG. 2, the fixing device 5 includes a heating roller 51, a pressing belt 52, supporting rollers 53 and 55, a cooler 54, and a pressuring member 56. In the heating roller 51, halogen lamps 51A1 and 51A2 are embedded as heaters. The pressing belt 52 is an endless belt that is pressed onto a part of the circumferential surface of the heating roller 51 such that it forms, together with the heating roller 51, a fixing nip area in which the recording sheet S is sandwiched between the pressing belt 52 and the heating roller 51. A surface of the recording sheet S, on which a toner image has been transferred by the second transfer, contacts the heating roller 51. The supporting rollers 53 and 55 suspend the pressing belt 52 with tension. The pressuring member 56 presses the pressing belt 52 from inside the pressing belt 52 in the fixing nip area to maintain a stable press-contacted state within the fixing nip area.

The heating roller 51 includes a cylindrical cored bar 51B, an elastic layer 51C layered on the circumferential surface of the cylindrical cored bar 51B, and mold release layer 51D layered on the elastic layer 51C. The halogen lamps 51A1 and 51A2 as a heat source are disposed inside the cored bar 51B.

Also, the heating roller 51 is provided with a temperature sensor 510. The controller 60 detects the current temperature of the heating roller through the temperature sensor 510, and further detects whether or not the temperature of the heating roller has reached the target fixing temperature (hereinafter referred to as "target temperature") that is set preliminarily for each type of recording sheet (for example, regular paper and thick paper).

The lighting of the halogen lamps 51A1 and 51A2 is controlled by the controller 60 in accordance with the size of the recording sheet. For example, under the control of the controller 60, when the recording sheet on which a toner image is to be thermally fixed has the size of "A3", both lamps are lighted; and when the recording sheet has the size of "A4", only one lamp (for example, halogen lamp 51A1) is lighted.

As the cylindrical cored bar 51B, for example, aluminum with thickness of 0.5 mm to 5 mm can be used.

As the elastic layer 51C, for example, silicon rubber with thickness of 0.5 mm to 2 mm can be used.

As the mold release layer 51D, for example, fluoroethylene resin with thickness of 20 μm to 80 μm can be used. As the fluoroethylene resin, for example, copolymer of tetrafluoroethylene and perfluoro alkyl vinyl ether (PFA) or polytetrafluoroethylene (PTFE) can be used.

The pressing belt 52 is made by covering, with a mold release layer, a belt made of a metal (nickel, copper, aluminum or the like) having a high heat conductivity.

For example, the metal belt may be nickel with thickness of 35 μm to 60 μm, and the mold release layer may be PFA with thickness of 20 μm to 80 μm.

The pressing belt 52 performs a circulating motion by passively following the rotation of the heating roller 51.

Note that the pressing belt 52 may be driven to circulate by one of the supporting rollers 53 and 55 that is driven by a driving motor.

The supporting rollers 53 and 55 are made of a metal (for example, a stainless steel).

Figure 3:
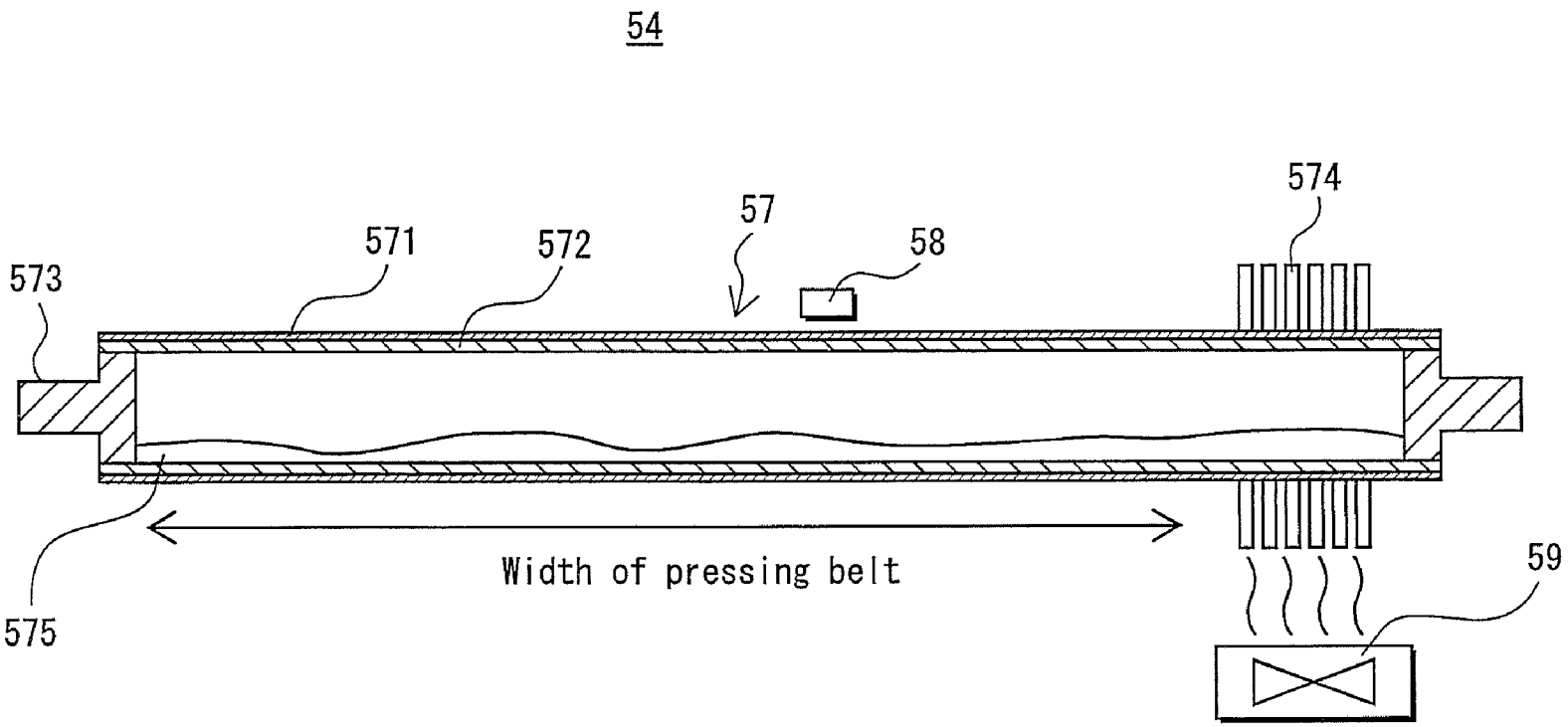
FIG. 3 is a cross-sectional view showing the structure of the cooler 54.

FIG. 3 is a cross-sectional view showing the structure of the cooler 54. As shown in FIG. 3, the cooler 54 is composed of a heat pipe 57 made of a heat-diffusion member, a pressing belt temperature sensor 58 for detecting an "index temperature" which refers to a temperature that indicates indirectly a temperature of the pressing belt 52, and a cooling fan 59.

The heat pipe 57 is longer than the width of the pressing belt 52. The heat pipe 57 includes a mold release layer 571, a cylindrical tube 572, bearings 573, a radiation fin 574, and an operating fluid 575. The cylindrical tube 572 is a hollow tube made of a material having a high heat conductivity (aluminum, copper, stainless steel, carbon steel or the like). The mold release layer 571 is formed on the circumferential surface of the cylindrical tube 572 (as the mold release layer, for example, fluoroethylene resin can be used). The bearings 573 seal the two ends of the cylindrical tube 572, respectively. The operating fluid 575 is a heat-carrying medium contained in the cylindrical tube 572. The radiation fin 574 is provided at one end of the cylindrical tube 572, on the outer surface of the mold release layer 571 covering the cylindrical tube 572.

Note that a wick layer may be formed on the inner surface of the cylindrical tube 572. The wick layer is provided to circulate the operating fluid 575 with use of the capillary action. The wick layer is made of, for example, a mesh of metal wire, a coil of metal wire, or a porous metal. The inside of the heat pipe 57 is maintained as a vacuum to accelerate the evaporation of the operating fluid 575. As the operating fluid 575, for example, water, alcohol, ammonia, chlorofluorocarbon, or an alternative for chlorofluorocarbon.

In the heat pipe 57, the heat emitted from the heating roller 51 transfers to the pressing belt 52 and causes the operating fluid 575 to evaporate to become water vapor. The water vapor moves to the low-temperature side having the radiation fin 574 and condenses into liquid, which flows back to the heat transfer side (a part that contacts the pressing belt 52) and becomes water vapor again.

With repetition of this cycle, in the heat pipe 57, the heat moves rapidly from the heat transfer side to the low-temperature side (a part that does not contact the pressing belt 52), and the pressing belt 52 is cooled. Further, by cooling the radiation fin 574 by driving the cooling fan 59 provided in the vicinity of the fin, it is possible to accelerate heat dissipation from the radiation fin 574, increase the temperature gradient at the low-temperature side from the heat transfer side to accelerate the heat transfer, and increase the speed of cooling the pressing belt 52. With this structure and control of driving of the cooling fan 59 by the controller 60, it is possible to cool the pressing belt 52 rapidly to the preset target temperature which will be described later.

[2] Structure of Controller 60

Figure 4:
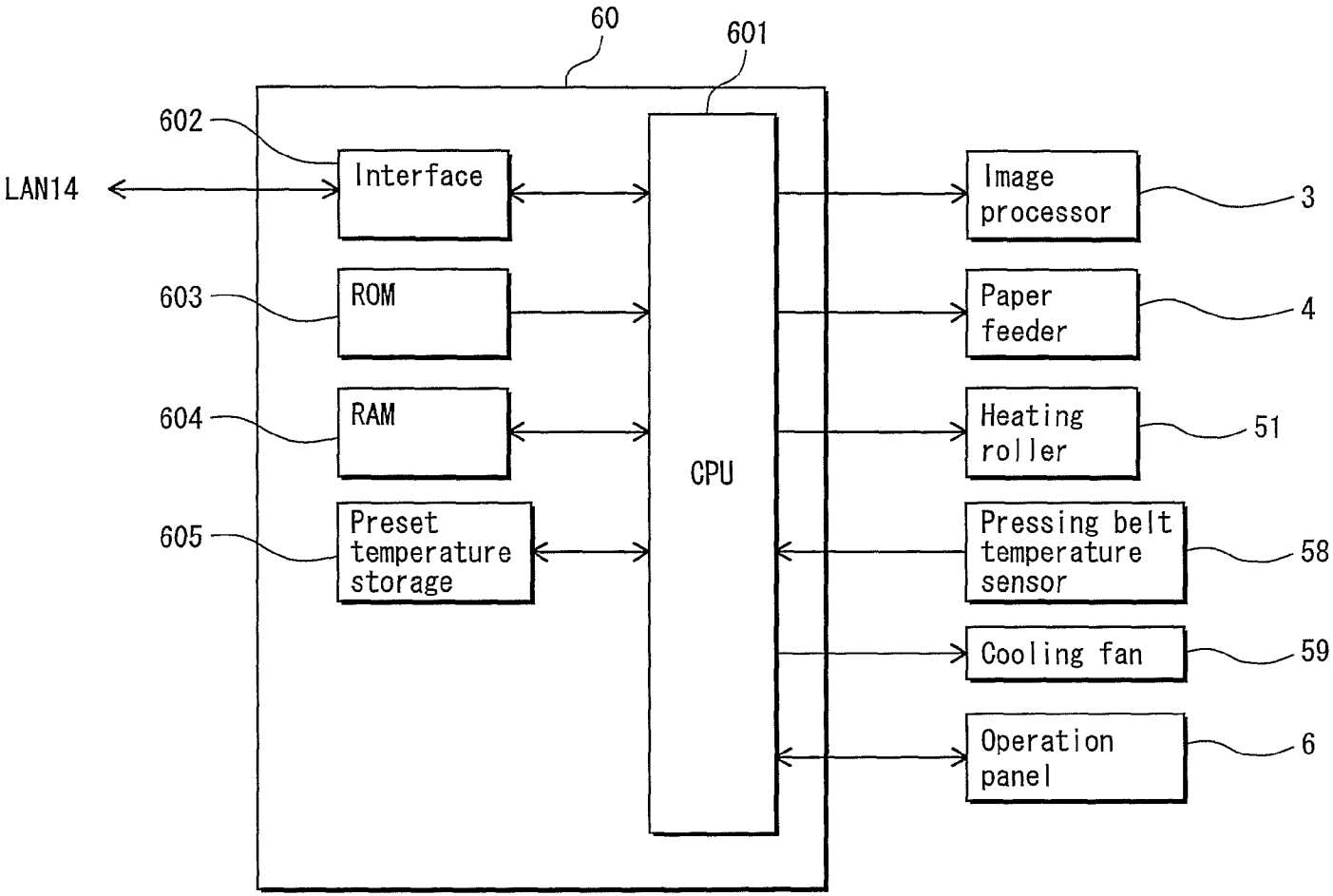
FIG. 4 is a functional block diagram showing the structure of the controller 60.

Next, the structure of the controller 60 will be described. FIG. 4 is a functional block diagram showing the structure of the controller 60. The controller 60 is what is called a computer, and, as shown in FIG. 4, includes a CPU (Central Processing Unit) 601, a communication interface 602, a ROM (Read Only Memory) 603, a RAM (Random Access Memory) 604, and a preset temperature storage 605.

The communication interface 602 is an interface such as a LAN card or a LAN board for connection with a LAN.

The ROM 603 stores a program necessary for controlling the image processor 3, the paper feeder 4, the heating roller 51 and the like, as well as a program necessary for controlling the cooling fan control process which will be described later.

The RAM 604 is used as a work area when the CPU 601 executes a program.

The preset temperature storage 605 stores a target preset temperature table. Here, the "target preset temperature table" is a table that shows types of recording sheets, preset target temperatures of the pressing belt 52 when a toner image is thermally fixed onto the types of recording sheets, target temperatures of the heating roller 51, and relationships among them.

The preset target temperatures of the pressing belt 52 are temperatures to which the pressing belt 52 are targeted to be cooled. The preset target temperatures are determined through experiments and are preliminarily set so that the difference in temperature on the paper-contact portion of the pressing belt 52 can be small between the initial passing and later passing of the recording sheet in the fixing nip, where the "paper-contact portion" refers to a range of the pressing belt 52 within which the recording sheet passing through the fixing nip contacts.

More specifically, the preset target temperatures are set as follows. That is to say, a fixing device, which does not have a function to cool the pressing belt 52 (a fixing device which does not have the cooler 54, but has a roller that is made of stainless steel like the supporting rollers 53 and 55), is used to perform the thermal fixing of a toner image onto each type of recording sheet a predetermined number of times (at least once: for example, five times), with the temperature of the heating roller 51 having been set to the target temperature corresponding to each type of recording sheet, and then the temperature of the paper-contact portion of the pressing belt 52 is measured.

Also, to offset the influence of the difference in temperature that is generated on the pressing belt 52, the temperature is measured at a plurality of positions in the paper-contact portion of the pressing belt 52, and an average value of the temperatures measured at the plurality of positions is set as the preset target temperature for the type of recording sheet in the thermal fixing operation.

In the cooling fan control process which will be described later, by performing a control so that the temperature of the pressing belt 52 becomes the preset target temperature for a type of recording sheet when the thermal fixing operation is performed onto the type of recording sheet, it is possible to preliminarily absorb from the pressing belt 52 the amount of heat that is expected to be transferred from the pressing belt 52 to the type of recording sheet when they contact each other. After the control, when the recording sheet actually contacts the pressing belt 52 that has been controlled to the preset target temperature, merely a slight amount of heat is absorbed from the pressing belt 52 by the recording sheet. It is thus possible to effectively prevent the difference in temperature from being generated between a part of the pressing belt 52 that contacted the recording sheet and a part of the pressing belt 52 that did not contact.

Furthermore, decrease of gloss level of the thermally fixed toner image is generated when the pressing belt 52 is cooled and the thermal fixing temperature is lowered. The target temperature of the heating roller 51 is set for each type of recording sheet to prevent this gloss defect from being generated.

FIG. 5 shows a specific example of the target preset temperature table. In FIG. 5, the preset target temperature of the pressing belt 52 and the target temperature of the heating roller 51 are indicated for each type of recording sheet (regular paper and thick paper). In FIG. 5, the values in the parentheses indicate weights per unit area that represent the levels in thickness of each type of recording sheet.

Back to the description with reference to FIG. 4, the CPU 601 reads out necessary control programs from the ROM 603, and executes processes based on the read-out control programs. That is to say, the CPU 601 controls the image processor 3, the paper feeder 4, the heating roller 51, and an operation panel 6 for receiving various instructions from the user, to perform the image forming operation smoothly. The CPU 601 also controls the operation in the cooling fan control process which will be described later, by controlling the driving of the cooling fan 59 based on the index temperature of the pressing belt 52 that is detected by the pressing belt temperature sensor 58.

[3] Operation in Cooling Fan Control Process

Figure 6:
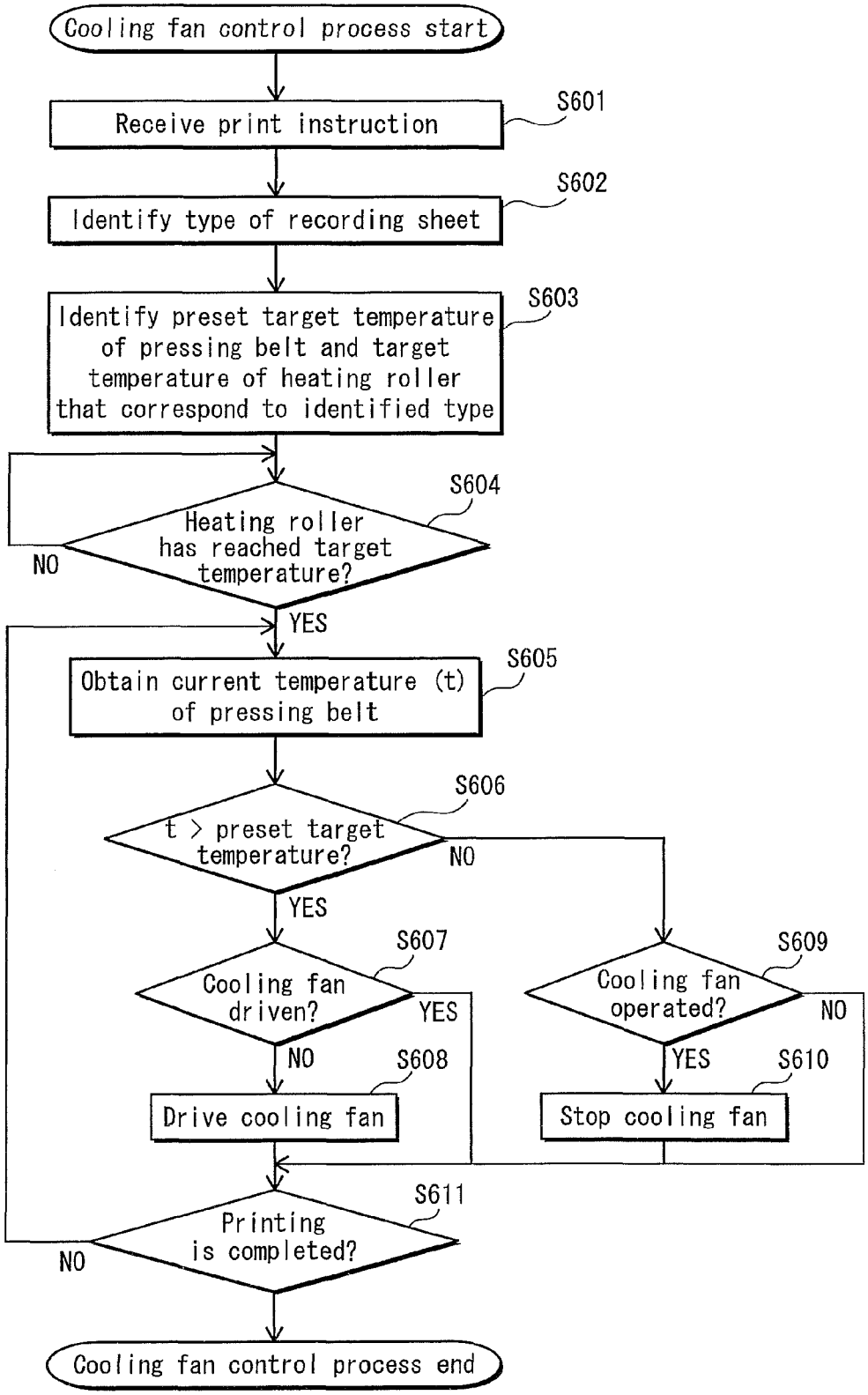
FIG. 6 is a flowchart showing the procedure of the operation in the cooling fan control process performed by the controller 60.

Next, the operation in the cooling fan control process performed by the controller 60 will be described. FIG. 6 is a flowchart showing the procedure of the operation.

The controller 60, upon receiving, from the user via the operation panel 6, a print instruction specifying a type of recording sheet on which a printing is to be made (step S601), identifies the type of recording sheet based on the print instruction (step S602), and identifies the preset target temperature of the pressing belt 52 and the target temperature of the heating roller 51 that correspond to the identified type of recording sheet, by referring to the target preset temperature table stored in the preset temperature storage 605 (step S603).

Next, the controller 60 heats the heating roller 51 by controlling the lighting of the halogen lamps 51A1 and 51A2, judges whether or not the temperature of the heating roller 51 has reached the target temperature (step S604), and when it judges that the temperature of the heating roller 51 has reached the target temperature (step S604: YES), obtains the current index temperature (t) of the pressing belt 52 via the pressing belt temperature sensor 58 (step S605), and judges whether or not the index temperature (t) has exceeded the preset target temperature (step S606).

When it judges that the index temperature (t) has exceeded the preset target temperature (step S606: YES), the controller 60 drives the cooling fan 59 (step S607: NO, step S608), and cools the pressing belt 52 until the temperature of the pressing belt 52 reaches the preset target temperature. When the pressing belt 52 is cooled to the preset target temperature (step S606: NO), the controller 60 stops the cooling fan 59 (step S609: YES, step S610), and starts the image forming operation, starting to fix a toner image onto the recording sheet by thermal fixing.

After this, the controller 60 repeats the process composed of steps S605 through S611 until the image forming operation is completed and the printing onto the recording sheet is completed, and when the printing is completed (step S611: YES), ends the cooling fan control process.

With the operation described above, the temperature of the pressing belt 52 is controlled to be cooled to the preset target temperature that corresponds to the type of recording sheet being transported on the belt. With this, merely a slight amount of heat is absorbed from the pressing belt 52 by the recording sheet when the thermal fixing of a toner image onto the recording sheet is performed. Accordingly, the present invention can effectively prevent the gloss difference from being generated, in spite of the absorption of the heat by recording sheet.

Also, the present invention controls temperature by merely controlling the driving of the cooling fan. This, compared with the method of heating the recording sheet as in the conventional technology, decreases the electric power consumption, and reduces the running cost. Furthermore, since the present invention controls temperature by cooling, there is no increase in temperature inside the image forming device, and thus there is no worry that the toner in the image processor 3 becomes hard by the influence of the heat.

Further, a control is performed to prevent the pressing belt 52 from being cooled excessively. That is to say, the cooling fan 59 is stopped when the temperature of the pressing belt 52 reaches the preset target temperature. This prevents generation of a gloss defect on the toner image due to decrease of the fixing temperature.

[4] Variations

Up to now, the present invention has been described through an embodiment thereof. However, the present invention is not limited to the embodiment, but includes, for example, the following variations.

(1) In the embodiment described above, the heat pipe 57 is used as a means for cooling the pressing belt 52. However, the cooling means is not limited to the heat pipe 57. For example, the pressing belt 52 may be directly cooled by a cooling fan, and as in the above-described embodiment, the controller 60 may control the driving of the cooling fan so that the pressing belt 52 is cooled to the preset target temperature.

Furthermore, the cooling may be done only to a paper-contact range of the pressing belt 52 within which the recording sheet passing through the fixing nip area contacts, where the range corresponds to the size of the recording sheet in the width direction of the pressing belt 52.

(2) In the embodiment described above, the preset target temperature is set as follows. First, the temperature of the heating roller 51 is set to the target temperature of the corresponding type of recording sheet. Then, the thermal fixing operation is performed a predetermined number of times (at least once: for example, five times), and the temperature of the paper-contact portion of the pressing belt 52 is measured. However, not limited to this procedure, for example, the following procedure is possible. That is to say, after the thermal fixing operation is performed a predetermined number of times (at least once: for example, five times), temperatures of both the paper-contact portion and a non-paper-contact portion of the pressing belt 52 are measured, and then an average value of the measured temperatures is set as the preset target temperature.

Also, in the embodiment described above, the preset target temperature of the pressing belt 52 is set on the premise that recording sheets of the same size are used. However, recording sheets of different sizes may be used as well. In that case, the setting of the preset target temperature as described in the embodiment or the variations may be performed for each size of recording sheet, and sizes of recording sheets may be recorded in the target preset temperature table of the preset temperature storage 605 in correspondence with the preset target temperatures, and in the cooling fan control process, a control may be performed so that the temperature of the pressing belt 52 becomes equal to the preset target temperature which, according to the target preset temperature table, corresponds to the size of the recording sheet that is to be subject to the thermal fixing.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A fixing device comprising:

an endless belt that is driven to perform a circulating motion;

a pressing member and a fixing roller that face each other with the endless belt therebetween, the pressing member being caused to press the fixing roller, which is preliminarily heated, via the belt to form a fixing nip in which a toner image is thermally fixed onto a recording sheet passing through therein;

a cooler that cools at least a paper-contact range of the belt within which the recording sheet passing through the fixing nip contacts; and a temperature-decrease controller that causes the cooler to cool at least the paper-contact range of the belt before the belt contacts the recording sheet.

2. The fixing device of claim 1, wherein the cooler includes:

a heat pipe that contacts an internal surface of the belt and is longer than a width of the belt;

a radiation fin that is provided on a portion of the heat pipe that projects out of the belt; and a cooling fan that sends air toward the radiation fin, and the temperature-decrease controller drives the cooling fan to cool the belt.

3. The fixing device of claim 1, wherein the temperature-decrease controller cools the belt by as much degree of temperature as is expected to decrease when the recording sheet passes through the fixing nip and contacts the belt.

4. The fixing device of claim 3, wherein the degree of temperature by which the belt is cooled by the temperature-decrease controller is preset for each type of recording sheet or for each size of recording sheet.

5. The fixing device of claim 1, wherein the temperature-decrease controller cools the belt by as much degree of temperature as is expected to decrease by absorption of heat by the recording sheet from the belt in the thermal fixing.

6. The fixing device of claim 1, wherein the belt is made of a metal having a heat conductivity.

7. The fixing device of claim 1, wherein the pressing member is provided inside a circulating path of the belt, and the fixing roller is a heating roller and is provided to face an outer surface of the belt.

8. The fixing device of claim 1, wherein the temperature-decrease controller activates the cooler upon receiving a print instruction, and causes the cooler to preliminarily absorb heat from the belt.

9. The fixing device of claim 1, wherein the temperature-decrease controller includes:

a detector that detects a temperature of the belt;

a judging unit that judges whether or not the temperature detected by the detector has decreased to a preset target temperature; and a permission unit that permits an image forming operation to be started when the judging unit judges that the temperature detected by the detector has decreased to the preset target temperature.

10. The fixing device of claim 9, further comprising:

a second detector that detects a surface temperature of the fixing roller; and a second judging unit that judges whether or not the surface temperature detected by the second detector has reached a target temperature, wherein the temperature-decrease controller activates the cooler after the second judging unit judges that the surface temperature detected by the second detector has reached the target temperature, and causes the cooler to cool at least the paper-contact range of the belt.

11. The fixing device of claim 1, wherein the temperature-decrease controller maintains the temperature of the belt at the preset target temperature by controlling the cooler.

12. The fixing device of claim 1, wherein the cooler includes a cooling fan, and the temperature-decrease controller includes:

a measuring unit that measures a temperature of the belt; and a judging unit that judges whether or not the temperature measured by the measuring unit has decreased to a preset target temperature, wherein the temperature-decrease controller activates the cooling fan upon receiving a print instruction, and stops the cooling fan and permits an image forming operation to be started when the judging unit judges that the temperature measured by the measuring unit has decreased to the preset target temperature.

13. An image forming device provided with a fixing device, the fixing device comprising:

an endless belt that is driven to perform a circulating motion;

a pressing member and a fixing roller that face each other with the endless belt therebetween, the pressing member being caused to press the fixing roller, which is preliminarily heated, via the belt to form a fixing nip in which a toner image is thermally fixed onto a recording sheet passing through therein;

a cooler that cools at least a paper-contact range of the belt within which the recording sheet passing through the fixing nip contacts; and a temperature-decrease controller that causes the cooler to cool at least the paper-contact range of the belt before the belt contacts the recording sheet.

* * * * *